US011419429B2

(12) United States Patent
Huang

(10) Patent No.: US 11,419,429 B2
(45) Date of Patent: Aug. 23, 2022

(54) ADJUSTABLE BED FRAME

(71) Applicant: Chia-Yen Huang, Taichung (TW)

(72) Inventor: Chia-Yen Huang, Taichung (TW)

( * ) Notice: Subject to any disclaimer, the term of this patent is extended or adjusted under 35 U.S.C. 154(b) by 107 days.

(21) Appl. No.: 16/816,301

(22) Filed: Mar. 12, 2020

(65) Prior Publication Data

US 2021/0219735 A1 Jul. 22, 2021

(30) Foreign Application Priority Data

Jan. 20, 2020 (TW) ..... 109200856

(51) Int. Cl.
*A47C 20/04* (2006.01)

(52) U.S. Cl.
CPC ..... *A47C 20/042* (2013.01); *A47C 20/041* (2013.01)

(58) Field of Classification Search
CPC ..... A47C 20/042; A47C 20/041; A47C 20/04; A47C 20/045; A47C 19/045; A47C 19/04; A47C 19/025; A47C 19/024; A61G 7/005; A61G 13/04; F16B 12/54
See application file for complete search history.

(56) References Cited

U.S. PATENT DOCUMENTS 251,267 A * 12/1881 McFarland ..... A47C 19/025 5/305
4,535,494 A * 8/1985 Diamonstein ..... A47C 23/06 5/200.1
5,704,249 A * 1/1998 Krauska ..... A47C 20/042 403/366
5,829,075 A * 11/1998 Stewart, Jr. ..... A47C 20/045 5/202
6,957,456 B2 * 10/2005 Darling ..... A47C 19/045 5/509.1
2001/0047546 A1 * 12/2001 Megown ..... A61G 7/0528 5/611
2007/0234477 A1 * 10/2007 Dorenbeck ..... A47C 19/045 5/618
2013/0019407 A1 * 1/2013 Sheppard ..... A47C 20/041 5/611
2015/0250323 A1 * 9/2015 Goldsmith ..... A61G 7/012 5/11
2020/0154899 A1 * 5/2020 Brown ..... A47C 20/041

* cited by examiner

*Primary Examiner* — Peter M. Cuomo
*Assistant Examiner* — Alison N Labarge

(57) ABSTRACT

An adjustable bed frame includes a frame, a front support unit connected to the front end of the frame, and a rear support unit connected to the rear end of the frame. The front support unit includes a first top connected to the front end of the frame, and a first bottom contacting a first plane. The rear support unit includes a second top connected to the rear end of the frame, and a second bottom contacting a second plane. An activation device is connected between the rear support unit and the frame. The activation device drives the rear support unit or the second bottom to move or rotate relative to the frame to change the shortest distance between the second bottom and the frame, and to change the distance between the frame and the second plane. The inclination between the frame and the first and second planes is adjusted.

10 Claims, 7 Drawing Sheets

ADJUSTABLE BED FRAME

FIELD OF THE INVENTION

The present invention relates to an adjustable bed frame, and more particularly, to an electric adjustable bed frame wherein the inclination relative to the floor can be adjusted.

BACKGROUND OF THE INVENTION

A conventional bed frame generally includes a rectangular main part which is connected to four support legs so as to support the bed frame on a floor. The four support legs include two front legs and two rear legs. However, the two front legs and the two rear legs cannot be adjustable relative to the rectangular main part. The user can only lie in the bed horizontally, and the conventional bed does not have the functions for adjusting the front end or the rear end of the bed to meet specific needs of the user.

Conventional cots are designed to facilitate handling and shipping, the bed frame of the conventional cot is designed to include a front frame and a rear frame. The front frame and the rear frame are pivotally connected to each other, so that the front frame and the rear frame are in a foldable state and become a so-called folding bed. During normal use, the front frame and the rear frame must be relatively unfolded and fixed so that the user can lie on it normally, however the entire bed frame cannot be adjusted to have a required inclination. Thus, the conventional folding bed does not have the function of adjusting the inclination angle of the bed frame, so the user cannot adjust the inclination angle of the bed frame for comfortable lying, and result in the inconvenience in use.

In addition, the conventional medical bed has the function of adjusting the tilt angle of the bed frame. However, it is not a general cot, and the mechanism of medical bed for adjusting the tilt angle is very complicated. The overall mechanism of the medical bed cannot be compared with the cot. It is known that the conventional medical bed with adjustable bed frame inclination function mainly has a base and a bed frame, the bottom of the base is arranged on a flat surface, and the top of the base is connected to the middle of the bed frame. A power mechanism is arranged between the base and the middle portion of the bed frame, and the inclination angle of the bed frame relative to the base is adjusted by the driving of the power mechanism. The base of the conventional medical bed with the function of adjusting tilt angle of the bed frame is no longer a simple structure with a front and a rear legs of a general cot, that is, the conventional medical bed with function of adjusting tilt angle of bed frame is not ordinary for a general cot, the overall structures of the medical bed and the general cot are completely different. The medical bed has a complicated structure and high cost, while the general cot has a simplified structure, low cost and convenient use.

The present invention intends to provide an electric adjustable bed frame so as to eliminate the shortcomings mentioned above.

SUMMARY OF THE INVENTION

The present invention relates to an adjustable bed frame that allows the users to easily adjust the inclination of the bed relative to a first plane and a second plane. The adjustable bed frame comprises a frame having a front end and a rear end. A front support unit is connected to the front end of the frame, and the front support unit includes a first top and a first bottom. The first top is connected to the front end of the frame, and the first bottom contacts a first plane. A rear support unit is connected to the rear end of the frame. The rear support unit has a second top and a second bottom, wherein the second top is connected to the rear end of the frame, and the second bottom contacts a second plane. An activation device is connected between the rear support unit and the frame.

When the activation device drives the rear support unit or the second bottom to move or rotate relative to the frame so as to change the shortest distance between the second bottom and the frame, and to change the distance between the frame and the second plane, such that an inclination between the frame and the first and second planes is adjusted.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 1-1 is an enlarged view of circle C in FIG. 1;

DETAILED DESCRIPTION OF THE PREFERRED EMBODIMENT

Figure 1:
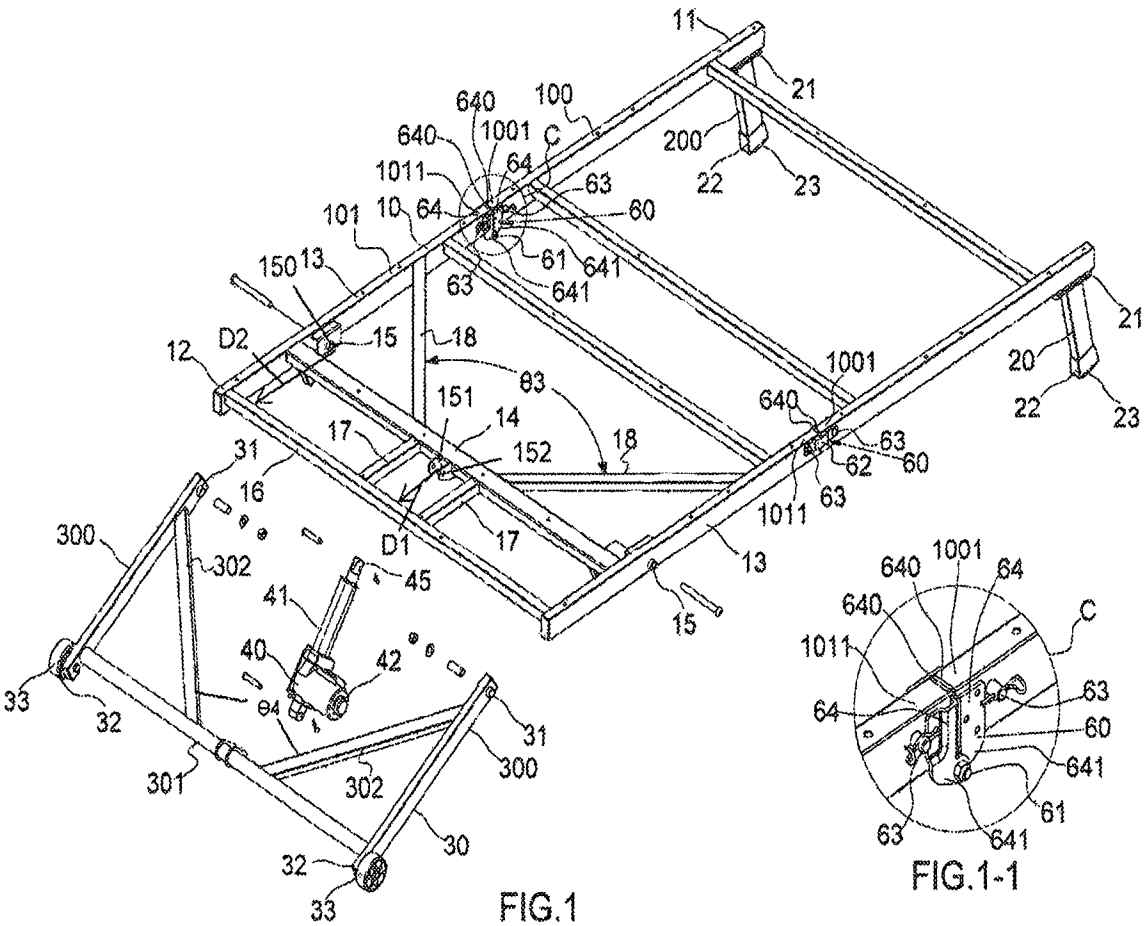
FIG. 1 is an exploded view to show the adjustable bed frame of the present invention.

Referring to FIGS. 1 to 8, the adjustable bed frame of the present invention comprises a frame 10, a front support unit 20 and a rear support unit 30. The frame 10 includes a front end 11 and a rear end 12. The front support unit 20 is connected to the front end 11 of the frame 10. The front support unit 20 includes a first top 21 and a first bottom 22. The first top 21 is connected to the front end 11 of the frame 10, and the first bottom 22 contacts a first plane P1. The front support unit 20 supports the frame 10 and the front end 11 of the frame 10 on the first plane P1. The rear support unit 30 is connected to the rear end 12 of the frame 10. The rear support unit 30 has a second top 31 and a second bottom 32, wherein the second top 31 is connected to the rear end 12 of the frame 10, and the second bottom 32 contacts a second plane P2. The rear support unit 30 supports the frame 10 and the rear end 12 of the frame 10 on the second plane P2.

An activation device 40 is connected between the rear support unit 30 and the frame 10. The activation device 40 is an electric linear retractable device. The activation device 40 drives the rear support unit 30 or the second bottom 32 to move or rotate relative to the frame 10 so as to change the shortest distance between the second bottom 32 and the frame 10, and to change the distance between the frame 10 and the second plane P2, such that the inclination between the frame 10 and the first and second planes P1, P2 is adjusted. Normally, the first and second planes P1, P2 are located on the same horizontally plane. In order to reduce the total volume for convenience of transportation, the frame 10 includes a front section 100 connected to the front support unit 20, and a rear section 101 connected to the rear support unit 30. The front section 100 has a first assembly end 1001 and the rear section 101 has a second assembly end 1011, wherein each of the first assembly end 1001 and the second assembly end 1011 has a connection device 60. The second assembly end 1011 is pivotably connected to the first assembly end 1001 by the two respective connection devices 60. The first assembly end 1001 contacts the second assembly end 1011. The first assembly end 1001 pivotally connect the second assembly end 1011 by a pivotal pin 61, so that the first assembly end 1001. is rotatable with respect to the second assembly end 1011 along the pivotal pin 61. A connection plate 62 is connected across the first assembly end 1001 and the second assembly end 1011. Two fixing pins 63 fix the connection plate 62 to the front section 100 and the rear section 101. In one embodiment, each connection device 60 comprises a pivotal pin 61, a connect plate 62, two fixing pins 63 and two connecting members 64, each connecting member 64 includes a reinforcing plate 640 and connecting plate 641. The reinforcing plate 640 is bended with respect to the connecting plate 641 so that there is an included angle about 90 degrees between the reinforcing plate 640 and the connecting plate 641. The first assembly end 1001 and the second assembly end 1011 are fixed with one reinforcing plate 640 of the two connecting members 64 through welding process. Lateral sides of the first assembly end 1001 and the second assembly end 1011 correspondingly contact with the connecting plates 641 of the two connecting members 64. The first assembly end 1001 and the second assembly end 1011 contact against each other through the reinforcing plates 640 of the two connecting members 64. The connecting plates 641 of the two connecting members 64 pivotally connect each other by the pivotal pin 61, so that the first assembly end 1001 pivotally connect the second assembly end 1011.

The front support unit 20 is integrally formed with the frame 10. The front support unit 20 has a rounded portion 23 formed to the first bottom 22. The rounded portion 23 moves and rolls along the first plane P1. When the rear support unit 30 and/or the second bottom 32 moves relative to the frame 10, the rounded portion 23 rolls on the first plane P1. The front support unit 20 includes two first lateral rods 200 whose respective top ends are pivotably connected to the two sides of the front end 11 of the frame 10. The two rounded portions 23 are connected to two respective bottoms of the two first lateral rods 200.

Two rollers 33 are connected to the second bottom 31 of the rear support units 30, and the two rollers 33 moves and rolls along the second plane P2. The rear support unit 30 includes two second lateral rods 300 whose respective top ends are pivotably connected to two sides of the rear end 12 of the frame 10. The two rollers 33 at connected to two respective bottoms of the two second lateral rods 300.

Figure 2:
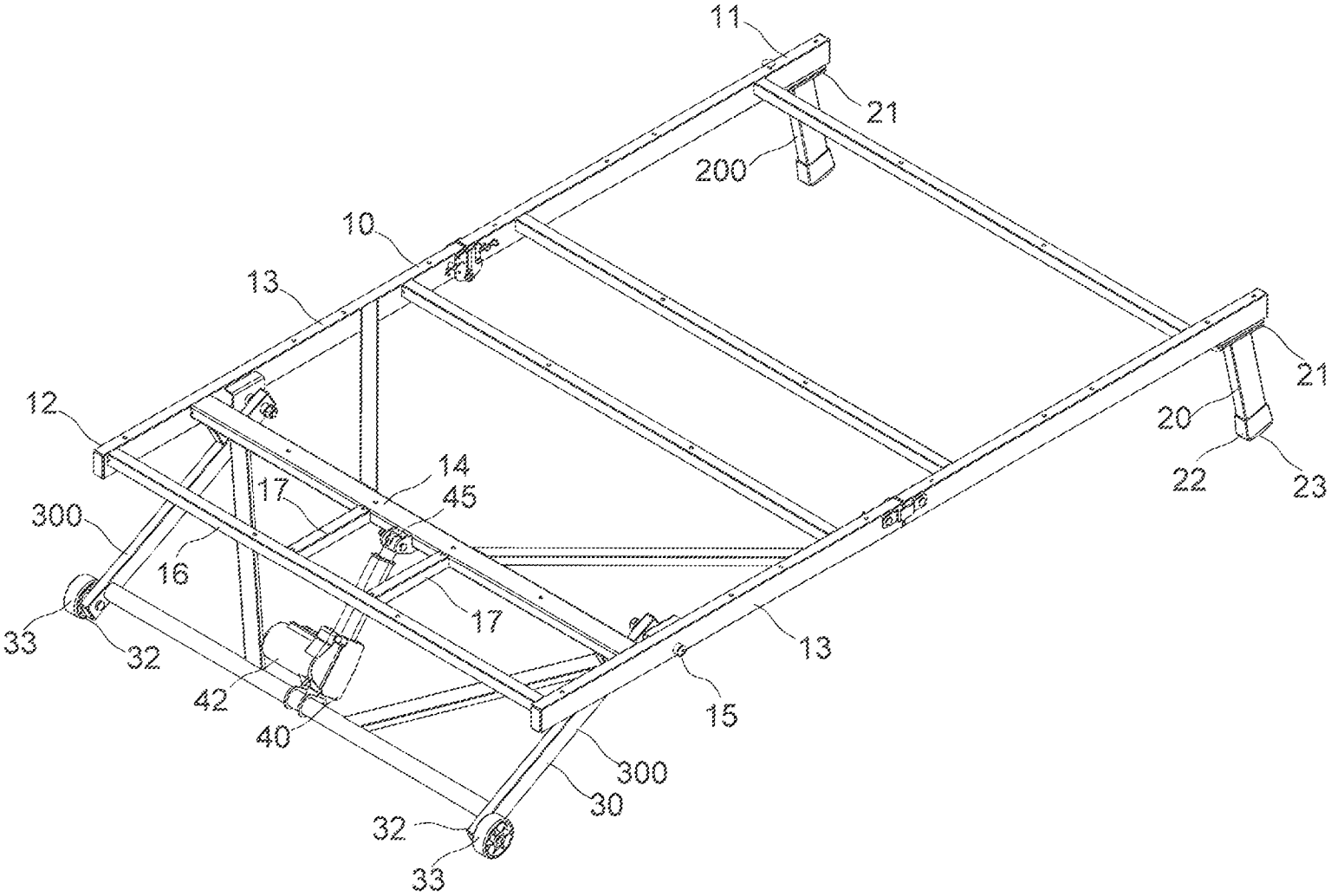
FIG. 2 is a perspective view to show the adjustable bed frame of the present invention.
Figure 3:
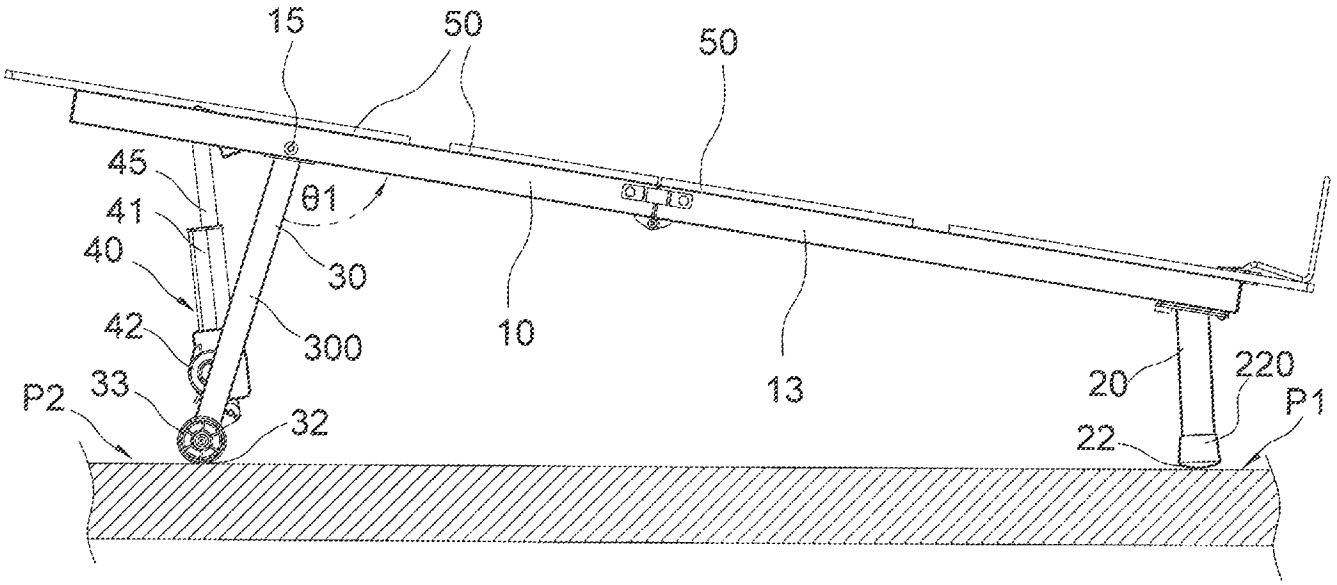
FIG. 3 shows that the bed frame is positioned at the first inclination.
Figure 4:
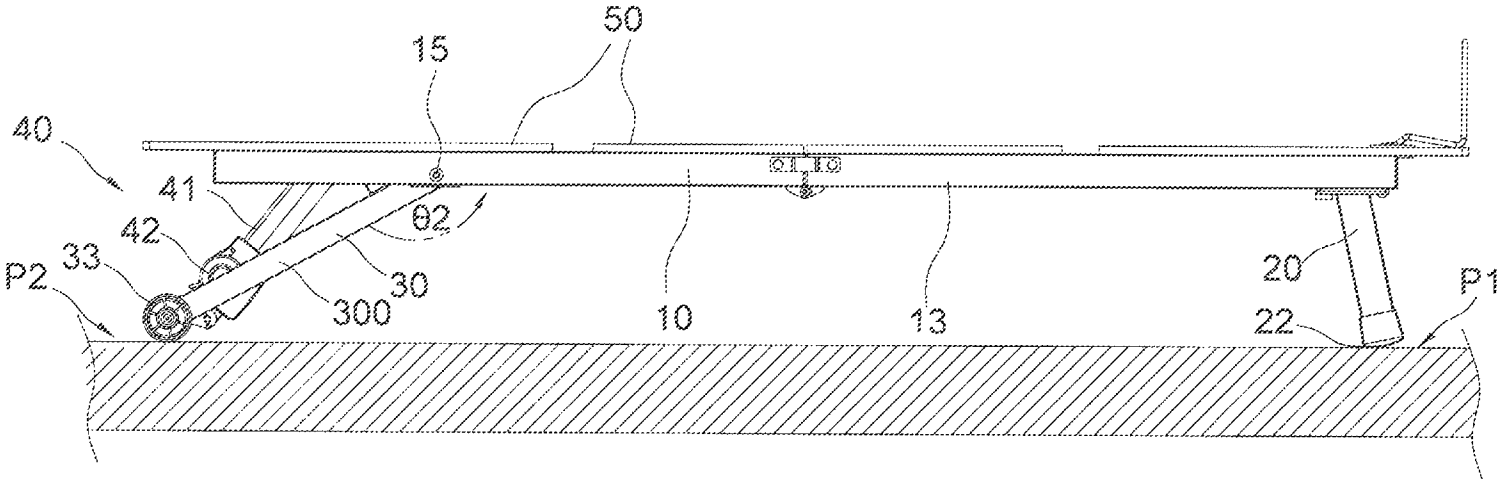
FIG. 4 shows that the bed frame is positioned at the second inclination.
Figure 5:
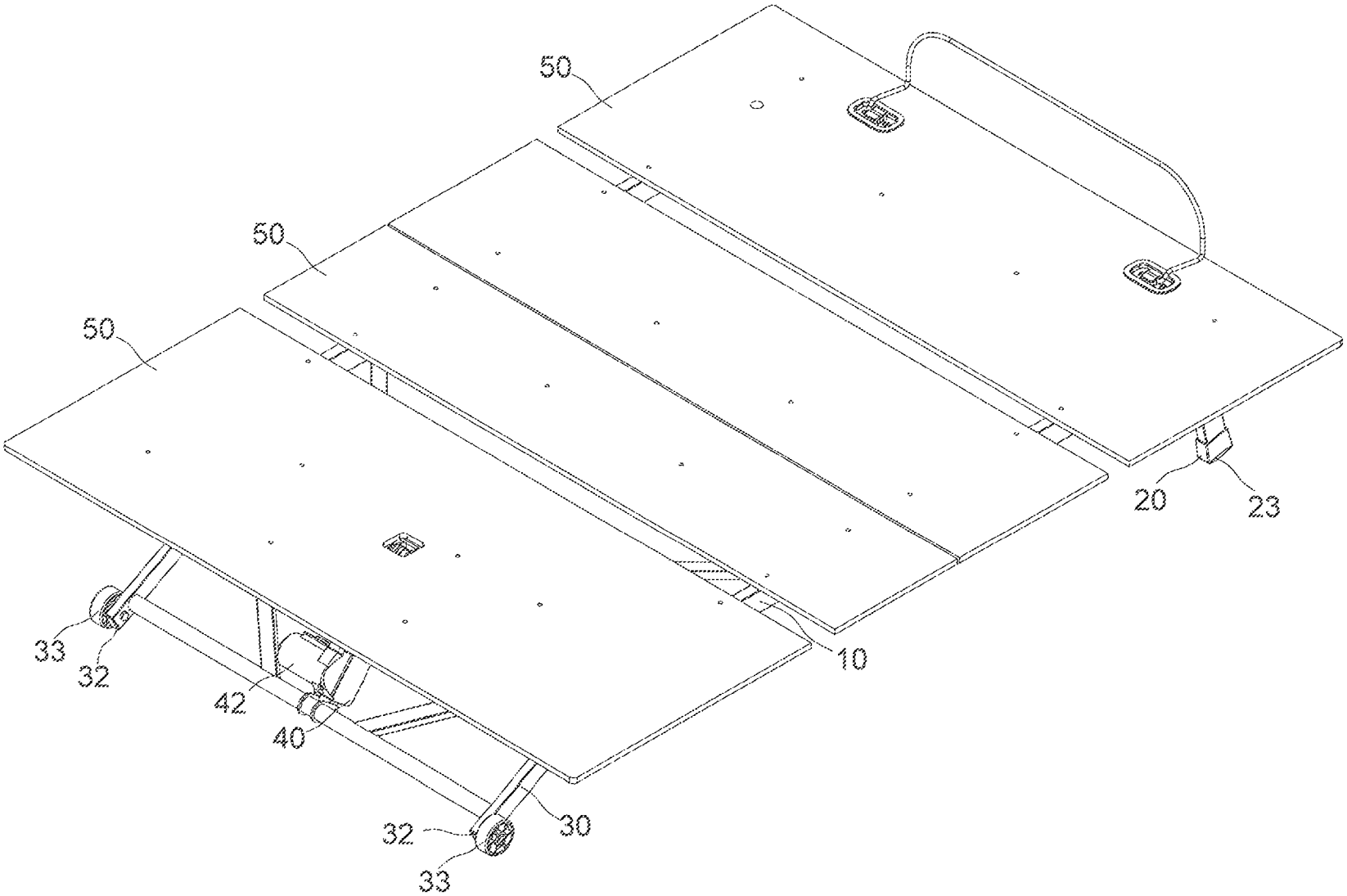
FIG. 5 illustrates boards are put on the adjustable bed frame of the present invention.
Figure 6:
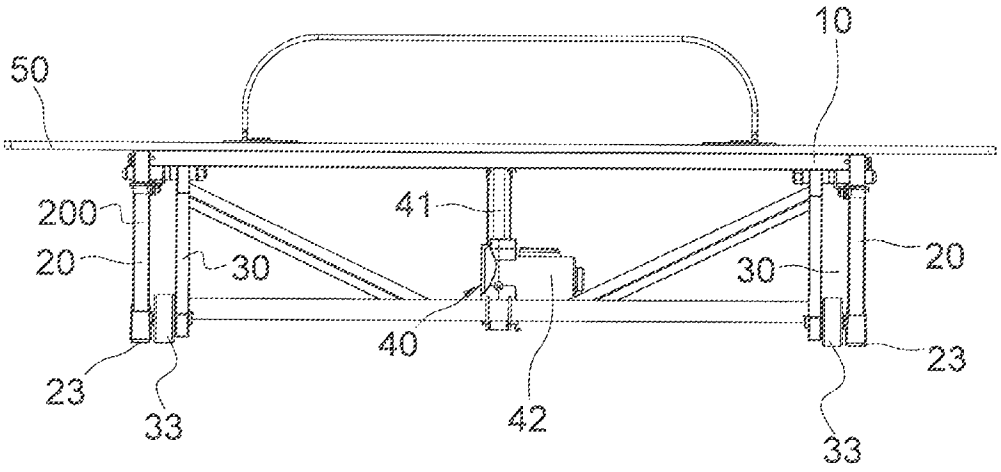
FIG. 6 is an end view to show that boards are put on the adjustable bed frame of the present invention.
Figure 7:
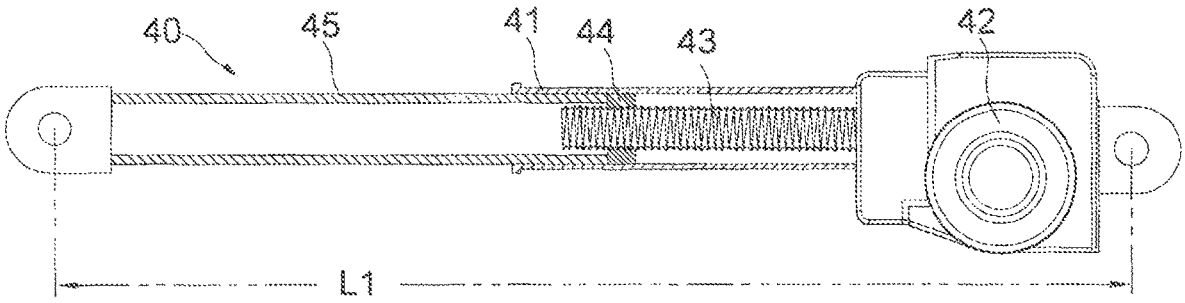
FIG. 7 illustrates the activation device is activated to be the first length.
Figure 8:
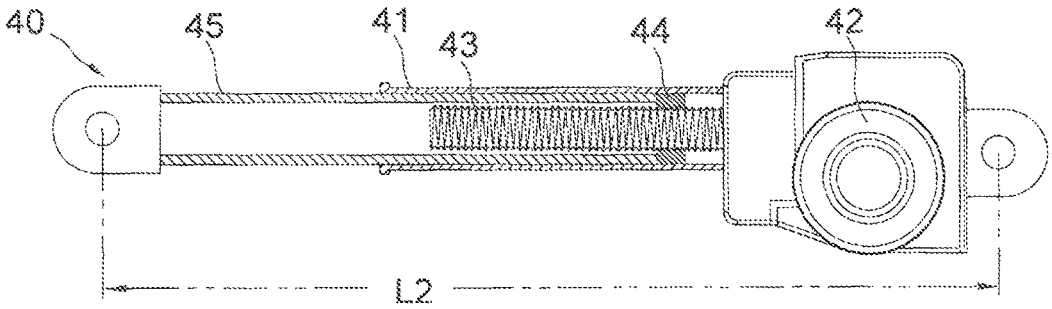
FIG. 8 illustrates the activation device is activated to be the second length.

As shown in FIGS. 3, 4, 7 and 8, the second top 31 of the rear support unit 30 is pivotably connected to the frame 10. The activation device 40 is a linear and retractable device and is directly and pivotably connected between the rear support unit 30 and the frame 10. When the activation device 40 extends between a first length L1 and a second length L2, the rear support unit 30 is pivoted between a first angle θ1 and a second angle θ2 relative to the frame 10. When the activation device 40 is activated to the first length L1, the frame 10 is located at a first inclination relative to the second plane P2 as shown in FIGS. 3 and 7. When the activation device 40 is activated to the second length L2, the rear support unit 30 is located at the second angle relative to the frame 10, the frame 10 is located at a second inclination relative to the second plane P2 as shown in FIGS. 4 and 8. As shown in FIGS. 1 and 2, when the frame 10 includes two first lateral rods 13 and a first transverse rod 14 which is fixed between the two first lateral rods 13. Two pivotal seats 15 are respectively fixed to the two first lateral rods 13 for the second top of the rear support unit 30 connecting thereto. The rear support unit 30 includes two second lateral rods 300 and a second transverse rod 301 which is fixed between two bottom ends of the two second lateral rods 300, the second transverse rod 301 is located at the second bottom of the rear support unit 30. Two ends of the activation device 40 is pivotably connected between the first and second transverse rods 14, 301. Preferably, the frame 10 includes a third transverse rod 16 secured between the two first lateral rods 13. Two first bars 17 are formed between the third transverse rod 16 and the first transverse rod 14. The two second bars 18 are formed between the two first lateral rods 13 and the first transverse rod 14. A third first included angle θ3 is formed between the two second bars 18. The first transverse rod 14 is located between the second bars 18 and the first bars 17. The rear support unit 30 includes two links 302 which are respectively formed between the two second lateral rods 300 and the second transverse rod 301. A second included angle θ4 is formed between the two links 302.. Rollers 33 are mounted on the rear support unit 30 for moving and rolling along the second plane P2. Wherein the second top of the rear support unit 30 is pivotably connected to the frame 10, the activation device 40 is a linear and retractable device, and the activation device 40 is pivotably connected to the rear support unit 30 and the frame 10 respectively so as to construct a three-bar linkage type of rigid structure. Wherein there is a first shortest distance D1 between the third transverse rod 16 and the first pivotal point 152 of the pivotal base 151, the pivotal base 151 is fixed on the first transverse rod 14 and the first pivotal point 152 is for the end of the activation device 40 pivotally connecting thereto, there is a second shortest distance D2 between the second pivotal point 150 of the pivotl seat 15 and the third transverse rod 16, the second pivotal point 150 is for the second top of the rear support unit 30 pivotally connecting thereto, and the first shortest distance D1 is smaller than the second shortest distance D2. Wherein when the activation device 40. extends between a first length L1 and a second length L2, the rear support unit 30 is pivoted between a first angle θ1 and a second angle θ2 relative to the frame 10. Wherein when the activation device 40 is activated to the first length L1 and the rear support unit 30 is located at the first angle θ1 relative to the frame 10, the rear support unit 30, the activation device 40 and the frame 10 construct a first three-bar linkage type of rigid structure (referring to FIG. 3), and the frame 10 is located at a first inclination relative to the second plane P2. Wherein when the activation device 40 is activated to the second length L2 and the rear support unit 30 is located at the second angle θ2 relative to the frame 10, the rear support unit. 30, the activation device 40 and the frame 10 construct a second three-bar linkage type of rigid structure (referring to FIG. 4), and the frame 10 is located at a second inclination relative to the second plane P2.

As shown in FIGS. 7 and 8, the activation device 40 includes a cylinder 41, a motor 42, a threaded rod 43, a nut 44 and a tube 45. The tube 45 axially and retractably inserted into one end of the cylinder 41 which is a tubular cylinder. The motor 42 is fixed to the cylinder 41. The threaded rod 43 is rotatably connected to the cylinder 41. The motor 42 drives the threaded rod 43 counter clockwise or clockwise. The nut 44 is threadedly mounted to the threaded rod 43. The cylinder 41 is pivotably connected to the rear support device 30, and the tube 45 is pivotably connected to the frame 10. When the motor 42 drives the threaded rod 43 to rotate clockwise, the nut 44 moves toward a distal end of the cylinder 41 and tube 45 extends from the cylinder 41. On the contrary, when the motor 42 drives the threaded rod 43 to rotate counter clockwise, the nut 44 moves toward a direction opposite to the distal end of the cylinder 41, so that the tube 45 retracts into the cylinder 41 by a reaction force from the second plane P2 due to the weight of the frame 10. When the first length L1 is larger than the second length L2, the first angle θ1 is smaller than the second angle θ2, the second inclination is smaller than the first inclination. When the rear support unit 30 rotated from the first angle θ1 to the second angle θ2, relative to the frame 10, the second bottom 32 moves close to the rear end 12 of the frame 10.

While we have shown and described the embodiment in accordance with the present invention, it should be clear to those skilled in the art that further embodiments may be made without departing from the scope of the present invention.

What is claimed is:

1. An adjustable bed frame comprising:

a frame having a front end and a rear end; the frame including two first lateral rods, a first transverse rod which is fixed between the two first lateral rods, and two pivotal seats being respectively fixed to the two first lateral rods;

a front support unit connected to the front end of the frame, the front support unit having a first top and a first bottom, the first top connected to the front end of the frame, the first bottom contacting a first plane;

a rear support unit connected to the rear end of the frame, the rear support unit having a second top and a second bottom, the second top connected to the rear end of the frame, the second bottom contacting a second plane, at least one roller being connected to the second bottom of the rear support unit, the at least one roller mounted on the rear support unit being for moving and rolling along the second plane: the rear support unit including two second lateral rods and a second transverse rod which is fixed between two bottom ends of the two second lateral rods; top ends of the two second lateral rods of the rear support unit pivotably connecting to the two pivotal seats correspondingly, and an activation device directly connected between the rear support unit and the frame, wherein the activation device drives the rear support unit to rotate relative to the frame, wherein the second top of the rear support unit being pivotably connected to the frame, the activation device being a linear and retractable device, the activation device being pivotably connected to the rear support unit and the frame respectively so as to construct a three-bar linkage type of rigid structure; wherein when the activation device extends between a first length and a second length, the rear support unit is pivoted between a first angle and a second angle relative to the frame; wherein when the activation device is activated to the first length and the rear support unit is located at the first angle relative to the frame, the rear support unit, the activation device and the frame construct a first three-bar linkage type of rigid structure, and the frame is located at a first inclination relative to the second plane; wherein when the activation device is activated to the second length and the rear support unit is located at the second angle relative to the frame, the rear support unit, the activation device and the frame construct a second three-bar linkage type of rigid structure, and the frame is located at a second inclination relative to the second plane; wherein two ends of the activation device being pivotably connected to the first and second transverse rods respectively; wherein the rear support unit including two links which are respectively formed between the two second lateral rods and the second transverse rod, an included angle being formed between the two links; and wherein the frame including a third transverse rod secured between the two first lateral rods, two first bars being formed between the third transverse rod and the first transverse rod.

2. The adjustable bed frame as claimed in claim 1, wherein the front support unit is integrally formed with the frame, the front support unit has a rounded portion formed to the first bottom, the rounded portion moves and rolls along the first plane, when the rear support unit and/or the second bottom moves relative to the frame, the rounded portion rolls on the first plane.

3. The adjustable bed frame as claimed in claim 1, wherein the activation device is an electric linear retractable device.

4. The adjustable bed frame as claimed in claim 3, wherein the activation device includes a cylinder, a motor, a threaded rod, a nut and a tube, the tube axially and retractably inserted into one end of the cylinder, the motor is fixed to the cylinder, the threaded rod is rotatably connected to the cylinder, the motor drives the threaded rod counter clockwise or clockwise, the nut is threadedly mounted to the threaded rod, the cylinder is pivotably connected to the rear support device, the tube is pivotably connected to the frame, when the motor drives the threaded rod to rotate clockwise, the nut moves toward a distal end of the cylinder and tube extends from the cylinder, when the motor drives the threaded rod to rotate counter clockwise, the nut moves toward a direction opposite to the distal end of the cylinder, the tube retracts into the cylinder by a reaction force from the second plane due to a weight of the frame.

5. The adjustable bed frame as claimed in claim 1, wherein two second bars are formed between the two first lateral rods and the first transverse rod correspondingly.

6. The adjustable bed frame as claimed in claim 5, wherein the first transverse rod is located between the two second bars and the two first bars; wherein there is a first shortest distance between the third transverse rod and a first pivotal point of a pivotal base, the pivotal base is fixed on the first transverse rod and the first pivotal point is for the end of the activation device pivotally connecting thereto; there is a second shortest distance between a second pivotal point of one of the two pivotal seats and the third transverse rod, the second pivotal point is for the second top of the rear support unit pivotally connecting thereto, and the first shortest distance is smaller than the second shortest distance.

7. The adjustable bed frame as claimed in claim 1, wherein the frame includes a front section connected to the front support unit, and a rear section connected to the rear support unit, the front section has a first assembly end and the rear section has a second assembly end which is pivotably connected to the first assembly end.

8. The adjustable bed frame as claimed in claim 7, wherein the first assembly end contacts the second assembly end, a pivotal pin extends through the first assembly end and the second assembly end, a connection plate is connected across the first assembly end and the second assembly end, two fixing pins fix the connection plate to the front section and the rear section.

9. The adjustable bed frame as claimed in claim 8, wherein two connecting members each includes a reinforcing plate and a connecting plate; the reinforcing plate is bent with respect to the connecting plate so that there is an included angle between the reinforcing plate and the connecting plate; the first assembly end and the second assembly end are fixed with one reinforcing plate of the two connecting members; lateral sides of the first assembly end and the second assembly end correspondingly contact with the connecting plates of the two connecting members; the first assembly end and the second assembly end contact against each other through the reinforcing plates of the two connecting members; the connecting plates of the two connecting members pivotally connect each other by the pivotal pin so that the first assembly end pivotally connects the second assembly end.

10. The adjustable bed frame as claimed in claim 1, wherein there is a first shortest distance between the third transverse rod and a first pivotal point of a pivotal base, the pivotal base is fixed on the first transverse rod and the first pivotal point is for the end of the activation device pivotally connecting thereto, there is a second shortest distance between a second pivotal point of one of the two pivotal seats and the third transverse rod, the second pivotal point is for the second top of the rear support unit pivotally connecting thereto, and the first shortest distance is smaller than the second shortest distance.

* * * * *